US006776397B2

(12) United States Patent
Vado et al.

(10) Patent No.: US 6,776,397 B2
(45) Date of Patent: Aug. 17, 2004

(54) CONVERTIBLE WINCH

(76) Inventors: Giovanni Antonio Vado, Regione Tanlera, Alghero (SS) (IT), 07041; Domenico Manca, Via Carrabufas Snc, Alghero (SS) (IT), 07041

( * ) Notice: Subject to any disclaimer, the term of this patent is extended or adjusted under 35 U.S.C. 154(b) by 0 days.

(21) Appl. No.: 10/425,672

(22) Filed: Apr. 30, 2003

(65) Prior Publication Data

US 2003/0213945 A1 Nov. 20, 2003

(30) Foreign Application Priority Data

May 17, 2002 (IT) ..... RM2002A0278

(51) Int. Cl.[7] ..... B66D 1/14
(52) U.S. Cl. ..... 254/342; 254/342; 475/294
(58) Field of Search ..... 254/329, 330, 254/331, 342, 345, 346, 354; 475/294, 296, 297

(56) References Cited

U.S. PATENT DOCUMENTS 3,927,580 A * 12/1975 Fawcett ..... 74/810.1
3,962,935 A * 6/1976 Hutton et al. ..... 74/810.1
3,968,953 A * 7/1976 Guangorena ..... 254/342
5,284,325 A * 2/1994 Sasaki et al. ..... 254/274
6,029,952 A * 2/2000 Huggett et al. ..... 254/344
6,042,086 A * 3/2000 Roberts ..... 254/344

FOREIGN PATENT DOCUMENTS

WO WO 91/14646 * 10/1991 ..... 254/342

* cited by examiner

*Primary Examiner*—Emmanuel M Marcelo
(74) *Attorney, Agent, or Firm*—Young & Thompson

(57) ABSTRACT

A convertible winch, comprises a basic body, motion transmission and reduction elements for the manual and powered operation, with a mono-direction rotation, and manual or powered operation according to at least two directions, with different rotation speed, and a central hole for the insertion of manual operation elements, the motion transmission and reduction elements providing at least a central gear, a lower gear, and a slidable side gear, coupling, by pawls, with the central gear or with the lower gear, determining the rotation according to different speed in function of the rotation direction of the manual or powered operation elements, the winch further providing, inside the body, an element interacting with the slidable gear, on which an operable button removably acts, inside the insertion central hole of the manual operation elements the interaction element being able to take two positions.

18 Claims, 1 Drawing Sheet

CONVERTIBLE WINCH

Figure 1:
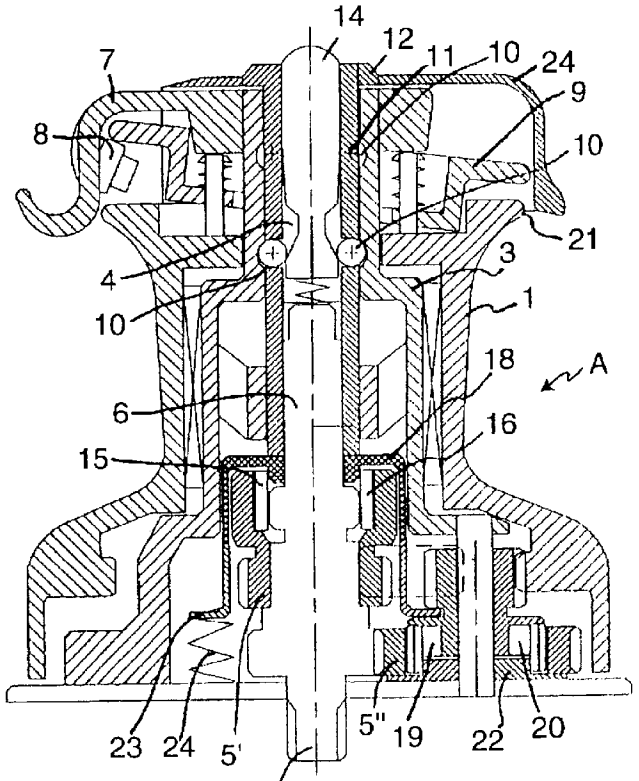

The present invention relates to a convertible winch.

More specifically, the invention concerns to a device of the above kind, the features of which are such to allow an optimum operation both manual and powered, with automatic operation.

Winch devices are known since many years, used to pull or heave out, or "haul aft" and "slacken" to use more seafaring terms, of every kind and destined to many manoeuvres.

Substantially, known winches are provided with a handle, or other kind of element on which the operator can act, said handle allowing to obtain the rotation of the winch only according to the rope winding direction. Rotation of the handle in the two different directions allows, due to a specific inner mechanism, to obtain the rotation of the winch, always in the same direction, but with a higher or lower transmission ratio, according to the specific needings.

For example, when the rope of a large sail, or the halyard of the same, is hauled aft, during the first stage, when the regulation is easier, and also more inaccurate, the handle is rotated according to the faster direction, while in the final phase of the regulation, it can be rotated according to the opposite direction, the winch always rotating according to the same direction. To slacken the sail, the operator acts manually slowly paying out the rope.

The same kind of winch can also be powered, maintaining the same kind of operation, being it also possible that it is provided of more than one operative speed.

Usually, winches of the above mentioned kind are provided on the deck of the boat.

In any case, both in the manual and powered operation, to slacken the rope, it is necessary to manually free the same from the holding device or "self-tailing", and thus manually slowly pay out the same rope.

Furthermore, powered winches exist having bi-directional rotation and operation, said winches being usually provided under-deck.

In this case, the winch is realised in such a way to haul aft according to a direction and heave out according to the other direction, without the double mono-direction rotation.

Bi-directional powered winch has the advantage of allowing the automatic rope release, really useful for the various adjustments.

At present, no solution is available on the market allowing to use the winch both in the mono-direction rotation mode, with different rotation speed, with manual and/or powered operation, and in the powered bi-directional rotation mode.

The Applicants have filed the Italian Utility Model N° 235. 637, concerning a rope lifting device provided with an innovative "self-tailing" system.

In view of the above, the Applicants have realised a technical solution allowing to reach the above mentioned result.

Particularly, the solution according to the present invention allows to have a convertible winch, operating both in the mono-direction rotation mode, with double or multiple rotation speed, with manual and powered operation, and in the bi-direction rotation mode.

It is therefore specific object of the present invention a convertible winch, comprising a basic body, motion transmission and reduction means, for the manual and powered operation, with a mono-direction rotation, and manual or powered operation according to at least two directions, with different rotation speed, and a central hole for the insertion of manual operation means, said motion transmission and reduction means providing at least a central gear, a lower gear, and a sliceable side gear, coupling, by pawls, with said central gear or with said lower gear, determining the rotation according to different speed in function of the rotation direction of the manual or powered operation means, said winch further providing, inside said body, means interacting with said sliceable gear, on which an operable button removably acts, inside said insertion central hole of the manual operation means said interaction means being able to take two positions, respectively a position locking said pawls, and a position releasing the same pawls, in order to obtain a uniform rotation according both directions, or a rotation according a single direction, with at least two different rotation speeds.

Preferably, according to the invention, said button is housed within a hollow shaft, inserted within said hole for the insertion of manual operation means.

Always according to the invention, said hollow shaft has a plurality of circumferential positioning spheres, coupling with suitable seats provided in said hole, and said button has a reduced diameter section, for interaction with said spheres.

Furthermore, according to the invention, said interaction means are comprised of a inverted U-shaped bracket provided, within said body, at the lower end of said button or hollow shaft, and acting on said slidable gear.

Particularly, said inverted U-shaped bracket, in correspondence of the end of the U legs, has two lateral projections acting, respectively, on said slidable gear and on buckling or upward thrust means, preferably one or more springs.

According to the invention, said winch provides a self-tailing system.

Figure 2:
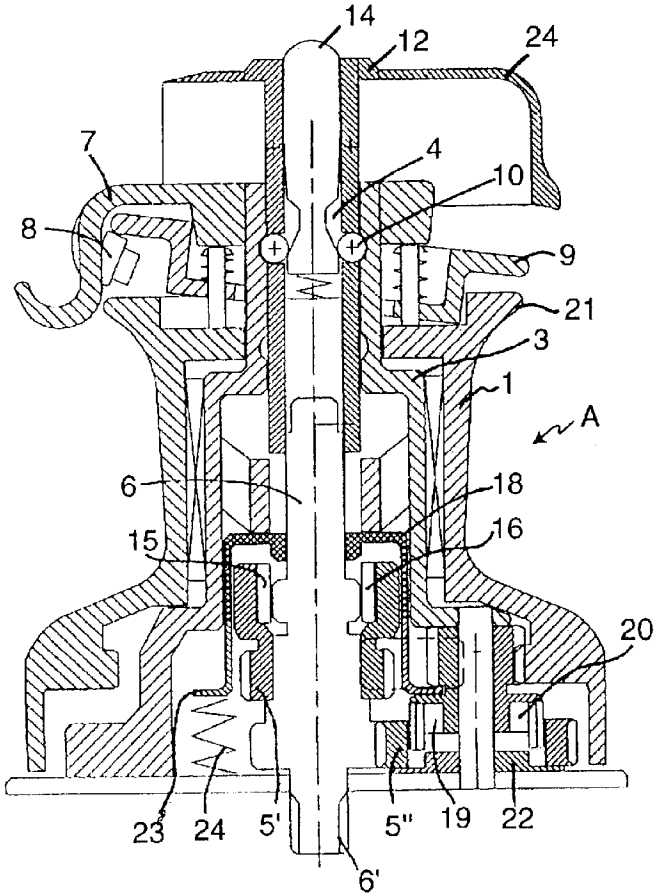

The present invention will be now described, for illustrative but not limitative purposes, according to its preferred embodiments, with particular reference to the figures of the enclosed drawings, wherein:

FIG. 1 is a section view of an embodiment of the winch according to the invention in a first position; and FIG. 2 is a section view of the winch of FIG. 1 in a second position.

Observing now the figures of the enclosed drawings, it is shown a solution according to the invention applied to a winch provided with the self-tailing solution according to the previous Italian Utility Model of the same Applicants. It is to be understood that the same solution can be applied also to standard winches or to winches with a different self-tailing system.

Winch according to the invention, generically indicated by the reference A, provides a suitably shaped body 1, having on its upper portion a bend 2, with guide limb 2', that will be useful as invitation for re-entry of the rope in case of powered operation and reverse rotation control.

Inside said body 1 the structure 3, suitably shaped, for the operation of the traditional inch, centrally provided with a hole 4 for the insertion of the rotation handle (not shown), and, in the lower portion, with motion transmission gears 5 according to both directions.

Inside said body, the motion transmission shaft 6 is provided, having its end 6' projecting downward, for the powered operation of the winch A.

Said gears 5 respectively provide a first central gear 5' and a second lower gear 5", on which pawls 19 and 20 act.

Elements indicated by numeral references 7, 8 and 9, respectively, are a bracket 7, provided with a roll and dilatation means, a buckling roll 8, that could be replaced by another equivalent element, and a counter-pulley 9, and represent the basic features of the solution object of the present invention.

According to the invention, along said hole 4 of the inner structure 3 to the body, and for the insertion of the handle, are realised, at different heights, two cavities 10, coupling with the spheres 11 that, as will be described in the following, will have the task of positioning the mechanism.

Within said hole 4 a hollow shaft 12 is inserted, within which a button 14 slides, to transform the bi-directional system, and for piloting of mono-directional crick pawls 15, 16. Said button 14 is provided with a reduced diameter portion 17, interacting with said spheres 11 for positioning of the mechanism.

Under said button 14 a bracket 18 is provided, said bracket having a substantially U shaped cross-section, interacting with the sliding cricks pawls 15, 16 of the mechanism transforming the operation system of the winch from manual into powered, and vice versa.

A slidable gear 21 is provided between said bracket 18 and said pawls 19 and 20, said gear 21 being part of the standard operative mechanism of the winch A, rising and descending due to the button operation 6, while under said pawls 19 and 20 a hat shaped locking washer 22 is provided.

At the end of the two legs of the U shaped portion of the bracket 18, two projections 23 are provided, acting on a first repositioning spring 24 (the number of springs 24 could be more than one) and on said slidable gear 21, respectively.

By the device according to the invention provided in winch A as shown in FIG. 1, an operation of the same winch A is obtained, if the button 14 is pressed, lifting the same, the rotating caliper is released, restoring the standard operation conditions, while extracting the assembly comprised of the button 14, along with the spheres 11, the hollow shaft 12 and the relevant protection and rope guide cover 24, cavity 4 is released to introduce the handle (not shown) and thus a traditional operation is restored for the winch A.

In other words, lug 23 of the U shaped bracket 18 acts on the sliding gear 21, thrusting the same downward, and thus locking pawls 19 and 20. In this way, winch A, when in the powered mode, can freely rotate according to both directions in a free and uniform way.

Instead, making the bracket 18 taking the position of FIG. 2, gear 21 is in the lifted position, so that the pawls 19 and 20 are released, allowing the regular manual or powered operation of winch A, with the rotation according to a single direction, with a different ratio in function of the handle rotation direction (not shown).

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. Convertible winch, comprising a basic body, motion transmission and reduction means, for the manual and powered operation, with a mono-direction rotation, and manual or powered operation according to at least two directions, with different rotation speed, and a central hole for the insertion of manual operation means, said motion transmission and reduction means providing at least a central gear, a lower gear, and a slidable side gear, coupling, by pawls, with said central gear or with said lower gear, determining the rotation according to different speed in function of the rotation direction of the manual or powered operation means, said winch further providing, inside said body, means interacting with said slidable gear, on which a operable button removably acts, inside said insertion central hole of the manual operation means said interaction means being able to take two positions, respectively a position locking said pawls, and a position releasing the same pawls, in order to obtain a uniform rotation according both directions, or a rotation according a single direction, with at least two different rotation speeds.

2. Convertible winch according to claim 1, characterised in that said button is housed within a hollow shaft, inserted within said hole for the insertion of manual operation means.

3. Convertible winch according to claim 2, characterised in that said hollow shaft has a plurality of circumferential positioning spheres, coupling with suitable seats provided in said hole, and said button has a reduced diameter section, for interaction with said spheres.

4. Convertible winch according to claim 2, characterised in that said interaction means are comprised of a inverted U-shaped bracket provided, within said body, at the lower end of said button or hollow shaft, and acting on said slidable gear.

5. Convertible winch according to claim 2, characterised in that said inverted U-shaped bracket, in correspondence of the end of the U legs, has two lateral projections acting, respectively, on said slidable gear and on buckling or upward thrust means.

6. Convertible winch according to claim 2, characterised in that said winch provides a self-tailing system.

7. Convertible winch according to claim 1, characterised in that said hollow shaft has a plurality of circumferential positioning spheres, coupling with suitable seats provided in said hole, and said button has a reduced diameter section, for interaction with said spheres.

8. convertible winch according to claim 7, characterised in that said interaction means are comprised of a inverted U-shaped bracket provided, within said body, at the lower end of said button or hollow shaft, and acting on said slidable gear.

9. Convertible winch according to claim 7, characterised in that said inverted U-shaped bracket, in correspondence of the end of the U legs, has two lateral projections acting, respectively, on said slidable gear and on buckling or upward thrust means.

10. Convertible winch according to claim 7, characterised in that said winch provides a self-tailing system.

11. Convertible winch according to claim 1, characterised in that said interaction means are comprised of a inverted U-shaped bracket provided, within said body, at the lower end of said button or hollow shaft, and acting on said slidable gear.

12. Convertible winch according to claim 11, characterised in that said inverted U-shaped bracket, in correspondence of the end of the U legs, has two lateral projections acting, respectively, on said slidable gear and on buckling or upward thrust means.

13. Convertible winch according to claim 12, characterised in that said buckling means are comprised of one or more springs.

14. Convertible winch according to claim 13, characterised in that said winch provides a self-tailing system.

15. Convertible winch according to claim 12, characterised in that said winch provides a self-tailing system.

16. Convertible winch according to claim 11, characterised in that said inverted U-shaped bracket, in correspondence of the end of the U legs, has two lateral projections acting, respectively, on said slidable gear and on buckling or upward thrust means.

17. Convertible winch according to claim 11, characterised in that said winch provides a self-tailing system.

18. Convertible winch according to claim 1, characterised in that said winch provides a self-tailing system.

* * * * *